US012735763B2

(12) United States Patent
Ma et al.

(10) Patent No.: US 12,735,763 B2
(45) Date of Patent: Sep. 15, 2026

(54) WIRE ROD FOR 5000 MPA-GRADE DIAMOND WIRE AND PRODUCTION METHOD THEREFOR

(71) Applicants: INSTITUTE OF RESEARCH OF IRON AND STEEL, JIANGSU PROVINCE/SHA-STEEL, CO. LTD (CN), Suzhou (CN); ZHANGJIAGANG RONGSHENG SPECIAL STEEL CO. LTD., Suzhou (CN); JIANGSU SHAGANG GROUP CO., LTD., Suzhou (CN)

(72) Inventors: Han Ma, Suzhou (CN); Kui Shen, Suzhou (CN); Xianjun Hu, Suzhou (CN); Lei Wang, Suzhou (CN)

(73) Assignees: INSTITUTE OF RESEARCH OF IRON AND STEEL, JIANGSU PROVINCE/SHA-STEEL, CO. LTD (CN), Suzhou (CN); ZHANGJIAGANG RONGSHENG SPECIAL STEEL CO. LTD., Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 658 days.

(21) Appl. No.: 18/247,741

(22) PCT Filed: Nov. 12, 2020

(86) PCT No.: PCT/CN2020/128268

§ 371 (c)(1),
(2) Date: Apr. 3, 2023

(87) PCT Pub. No.: WO2022/082900

PCT Pub. Date: Apr. 28, 2022

(65) Prior Publication Data

US 2023/0416865 A1 Dec. 28, 2023

(30) Foreign Application Priority Data

Oct. 22, 2020 (CN) ..... 202011134922.3

(51) Int. Cl.

| | |
|---|---|
| ***C21D 9/52*** | (2006.01) |
| ***C21B 13/12*** | (2006.01) |
| ***C21D 7/13*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/24*** | (2006.01) |
| ***C22C 38/28*** | (2006.01) |
| ***C22C 38/32*** | (2006.01) |

(52) U.S. Cl.
CPC ..... *C21D 9/525* (2013.01); *C21B 13/12* (2013.01); *C21D 7/13* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/24* (2013.01); *C22C 38/28* (2013.01); *C22C 38/32* (2013.01); *C21D 2261/00* (2013.01)

(58) Field of Classification Search
CPC ..... C21D 9/525
See application file for complete search history.

(56) References Cited

U.S. PATENT DOCUMENTS

| | | | | |
|---|---|---|---|---|
| 3,711,918 A * | 1/1973 | Shore | B21C 47/262 29/564.6 |
| 2020/0048731 A1* | 2/2020 | Manabe | C21D 6/008 |

FOREIGN PATENT DOCUMENTS

| | | | |
|---|---|---|---|
| CN | 1609252 | A | 4/2005 |
| CN | 101208445 | A | 6/2008 |
| CN | 101331243 | A | 12/2008 |
| CN | 101341270 | A | 1/2009 |
| CN | 101649416 | A | 2/2010 |
| CN | 102181786 | A | 9/2011 |
| CN | 102534094 | A | 7/2012 |
| CN | 103717326 | A | 4/2014 |
| CN | 108396128 | A | 8/2018 |
| CN | 108559908 | A | 9/2018 |
| CN | 109468530 | A | 3/2019 |
| CN | 110230008 | A | 9/2019 |
| CN | 110238230 | A | 9/2019 |
| CN | 110318001 | A | 10/2019 |
| CN | 110669981 | A | 1/2020 |

(Continued)

OTHER PUBLICATIONS

International Search Report in International application No. PCT/CN2020/128268 mailed on Jun. 24, 2021, with English translation provided by WIPO.
Written Opinion of the International Searching Authority in International application No. PCT/CN2020/128268 mailed on Jun. 24, 2021, with English translation provided by WIPO.

*Primary Examiner* — Christopher S Kessler
(74) *Attorney, Agent, or Firm* — Ladas & Parry, LLP

(57) ABSTRACT

A wire rod for a 5000 MPa-grade diamond wire and a production method are provided. The wire rod includes the following chemical components: 1.01% to 1.1% of carbon, 0.15% to 0.4% of silicon, 0.3% to 0.6% of manganese, 0.01% to 0.4% of chromium, 0.0005% to 0.002% of boron and/or 0.01% to 0.09% of vanadium; and the balance of iron and impurities. The production method includes vacuum melting, electroslag remelting and/or vacuum consumable melting, grinding after cogging/forging, high-speed wire rolling and cooling, and cogging at 1030° C. to 1060° C. The wire rod, with structural uniformity and tensile strength of more than or equal to 1320 MPa, can be configured to prepare 5000 MPa-grade steel wires with a diameter of 40 μm to 46 μm.

14 Claims, No Drawings

(56) References Cited

FOREIGN PATENT DOCUMENTS

| | | | |
|---|---|---|---|
| CN | 111041352 | A | 4/2020 |
| CN | 111187992 | A | 5/2020 |
| JP | H3-253544 | A | 11/1991 |
| JP | 2005002413 | A | 1/2005 |

* cited by examiner

WIRE ROD FOR 5000 MPA-GRADE DIAMOND WIRE AND PRODUCTION METHOD THEREFOR

CROSS-REFERENCE TO RELATED APPLICATIONS

This application is the U.S. national phase of PCT Application No. PCT/CN2020/128268 filed on Nov. 12, 2020, which claims priority to Chinese Patent Application No. 202011134922.3 filed in China on Oct. 22, 2020, the disclosures of which are incorporated herein by reference in their entireties.

TECHNICAL FIELD

The present invention falls within the technical field of material preparation, and relates to a method for producing a wire rod for a 5000 MPa-grade diamond wire and a wire rod prepared by adopting the production method.

BACKGROUND

A sawing wire, also known as a cutting wire, a cutting steel wire and a cutting line, is a special wire for cutting, is also a special steel wire having a diameter of less than 0.20 mm and plated with zinc and copper, and has been widely applied to the fields of energy sources, aviation, facilities, and public utilities as a consumable material. A diamond wire, as a high-carbon sawing wire having diamond fine particles embedded on the surface, is mainly configured to cut and form materials such as solar silicon wafers, quartz materials, monocrystalline silicon, polycrystalline silicon, and diamond.

To reduce the loss of materials to be cut such as silicon materials during cutting, the diamond wires have been developed in a tendency of smaller diameters, longer continuous wire mileages and stronger strength. Therefore, the requirements on raw materials for producing the sawing wires, for example, high-carbon steel wire rods, are increasingly strict, that is, higher requirements on the purity, structural uniformity, mechanical properties and drawing properties of the wire rods are put forward. Specifically, it is required to control the size of inclusions to be smaller, the structure to be more uniform, and abnormal structures such as martensite, bainite, and network carbides which affect drawing to be not formed, and to ensure the plasticity of the wire rod while enhancing the strength as much as possible.

However, at present, there are still no wire rods configured to draw to prepare 5000 MPa-grade diamond wires, that is, existing wire rods basically cannot be prepared into the 5000 MPa-grade diamond wires under the condition of meeting the basic requirements of diameters and continuous wire mileages.

SUMMARY

To address the aforementioned technical problems, the present invention is intended to provide a wire rod and a production method therefor, which can be used for preparing a 5000 MPa-grade diamond wire bus by deep drawing and meet high requirements of the market on the diameter and the wire breakage rate of diamond wires.

To achieve the above invention objective, an embodiment of the present invention provides a method for producing a wire rod for deep drawing, in particular, a method for producing a wire rod configured to be drawn into a 5000

MPa-grade diamond wire. The wire rod includes the following chemical components in percentage by mass: 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V. The balance of Fe and unavoidable impurities, where the impurities include less than or equal to 0.003% of Al, less than or equal to 0.0008% of Ti, less than or equal to 0.005% of S, less than or equal to 0.008% of P, less than or equal to 0.0010% of O and less than or equal to 0.0020% of N; and the production method includes the following processes:

- vacuum melting: melting molten steel by adopting a vacuum melting furnace in an atmosphere with a pressure in the furnace below 10 Pa, and casting same into a steel ingot;
- steel ingot remelting: processing the steel ingot by adopting either or both of electroslag remelting and vacuum arc remelting to obtain a remelted ingot, where the electroslag remelting is carried out under a protective atmosphere, and a remelting speed of the vacuum arc remelting is 3.0 kg/min to 3.5 kg/min;
- billet making and grinding: cogging or forging the remelted ingot into a steel billet, and grinding the steel billet;
- high-speed wire rolling: rolling the steel billet into the wire rod, with a start rolling temperature of 1030° C. to 1060° C., and a finish rolling temperature of 950° C. to 1020° C.; and
- cooling: carrying out temperature-controlled cooling on the wire rod on a Stelmor cooling line, starting $1^{st}$ to $4^{th}$ fans with air quantities of 80% to 100%, and closing the rest fans.

To achieve the above invention objective, an embodiment of the present invention provides a method for producing a wire rod for deep drawing, in particular, a method for producing a wire rod configured to be drawn into a 5000 MPa-grade diamond wire, and the production method includes the following processes:

- vacuum melting: adding alloy elements into molten iron according to a composition design of 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V, and melting molten steel by adopting a vacuum melting furnace in an atmosphere with a pressure in the furnace below 10 Pa, and casting same into a steel ingot;
- steel ingot remelting: processing the steel ingot by adopting either or both of electroslag remelting and vacuum arc remelting to obtain a remelted ingot, chemical components of the remelted ingot including C, Si, Mn, Cr, and either or both of B and V and the balance of Fe and unavoidable impurities, the impurities including elements of less than or equal to 0.003% of Al, less than or equal to 0.0008% of Ti, less than or equal to 0.005% of S, less than or equal to 0.008% of P, less than or equal to 0.0010% of O and less than or equal to 0.0020% of N, where the electroslag remelting is carried out under a protective atmosphere, and a remelting speed of the vacuum arc remelting is 3.0 kg/min to 3.5 kg/min;
- billet making and grinding: cogging or forging the remelted ingot into a steel billet, and grinding the steel billet;
- high-speed wire rolling: rolling the steel billet into the wire rod, with start rolling temperature of 1030° C. to 1060° C., and a finish rolling temperature of 950° C. to 1020° C.; and cooling: carrying out temperature-controlled cooling on the wire rod on a Stelmor cooling line, starting $1^{st}$ to $4^{th}$ fans with air quantities of 80% to 100%, and closing the rest fans.

Further preferably, in the vacuum melting process, the pressure in the furnace is below 5 Pa.

Further preferably, in the vacuum melting process, the molten steel is melted in the vacuum melting furnace by using industrial pure iron with less than or equal to 0.001% of Al, less than or equal to 0.0005% of Ti, less than or equal to 0.001% of Cu, and less than or equal to 0.001% of Ni as a raw material and adding alloy elements according to a composition design.

Further preferably, in the vacuum melting process, a casting temperature is 1580° C. to 1620° C.

Further preferably, in the steel ingot remelting process, heat preservation is performed on the obtained remelted ingot for 48 hours or more after the remelted ingot is obtained by adopting the vacuum arc remelting.

Further preferably, in the billet making process, the remelted ingot is cogged or forged into a square billet having a length of 9 m to 16 m and a size of 145 mm×145 mm.

Further preferably, in the billet making process, the remelted ingot is cogged or forged at a temperature of 1130° C. to 1160° C.

Further preferably, in the grinding process, the total grinding depth on the surface of the steel billet is more than or equal to 1.5 mm.

Further preferably, in the grinding process, grinding treatment is carried out on the surface of the steel billet by using 16-mesh, 24-mesh and 30-mesh grinding wheels in sequence, and the grinding depth of each pass is respectively more than or equal to 0.9 mm, more than or equal to 0.5 mm and more than or equal to 0.1 mm, and the grinding width of a corner is more than or equal to 5 mm.

Further preferably, in the high-speed wire rolling process, the steel billet is rolled into the wire rod with a diameter of phi 4.5 mm to phi 5.5 mm.

Further preferably, in the high-speed wire rolling process, a finishing speed is 100 m/s to 110 m/s.

Further preferably, in the high-speed wire rolling process, a spinning temperature is 890° C. to 920° C.

Further preferably, in the cooling process, in front of the $1^{st}$ fan, a running speed of an inlet section of a roller way is 0.9 m/s to 1.0 m/s.

Further preferably, in the cooling process, all heat preservation covers are opened, and the ratio of the running speeds of the roller ways corresponding to the $1^{st}$ to $4^{th}$ fans is 1.10:1.05:1.02:1.00.

Further preferably, in the cooling process, a wind speed at an overlapping point is adjusted to be 1.1 to 1.4 times of the wind speed at a non-overlapping point by using optitflex.

Further preferably, the production method further includes a heat treatment process: carrying out salt bath heat treatment or lead bath heat treatment on the wire rod cooled on the Stelmor cooling line, where a temperature of an isothermal phase change stage is 520° C. to 560° C. and time is 20 s to 80 s.

Further preferably, when the wire rod prepared by the production method is packed by adopting a packing thread, the packing thread and the wire rod are separated by adopting a flexible wear-resistant material, and then aging treatment is carried out, where the time for the aging treatment is more than or equal to 10 days when the room temperature is more than or equal to 15° C., and is more than or equal to 20 days when the room temperature is less than 15° C.

To achieve the above invention objective, an embodiment of the present invention provides a wire rod for deep drawing, which is prepared by adopting the production method according to any one of the foregoing embodiments, in particular, a wire rod configured to be drawn into a 5000 MPa-grade diamond wire. The wire rod includes the following chemical components in percentage by mass: 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V. The balance of Fe and unavoidable impurities, where the impurities include less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

Further, the diameter of the wire rod is phi 4.5 mm to phi 5.5 mm.

Further, a tensile strength of the wire rod is more than or equal to 1320 MPa, and a reduction of area is more than or equal to 30%.

Further, the maximum inclusion size of the wire rod is less than or equal to 4 μm, and a network carbide is less than or equal to grade 1.0.

Further, the maximum inclusion size is less than or equal to 4 μm, including the maximum inclusion size in the transverse direction being less than or equal to 4 μm and the maximum inclusion size in the longitudinal direction being less than or equal to 4 μm.

Further, the detection ratio of the network carbide is less than or equal to 30%, and the central carbon segregation ratio is less than or equal to 1.03.

Further, the surface crack depth of the wire rod is less than or equal to 30 μm, the depth of a decarburized layer is less than or equal to 40 μm, the proportion of the decarburized layer in the total circumference is less than or equal to 15%, and the thickness of a surface oxide scale is 7 μm to 15 μm.

To achieve the above invention objective, an embodiment of the present invention provides a wire rod for deep drawing, in particular, a wire rod configured to be drawn into a 5000 MPa-grade diamond wire, which includes the following chemical components in percentage by mass: 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V. The balance of Fe and unavoidable impurities, where the impurities include less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

Also, a tensile strength of the wire rod is more than or equal to 1320 MPa, a reduction of area is more than or equal to 30%, the maximum inclusion size is less than or equal to 4 μm, and the network carbide is less than or equal to grade 1.0.

Compared with the prior art, the present invention has the following beneficial effects.

(1) By increasing the content of pearlite strengthening elements, particularly element C, matching with addition of B and/or V, and strictly controlling the content of impurity elements, the structural uniformity is ensured, high-melting-point inclusions are prevented from being formed, and the purity, tensile strength and drawing properties are improved.

(2) By regulating and controlling the pressure in the furnace in the vacuum melting process, and carrying out the electroslag remelting process under the protective atmosphere, or/and regulating and controlling the remelting speed during the vacuum arc remelting, the chemical components in the material are finely controlled, high purity is ensured, the generation of the inclusions is greatly reduced, and the sizes of the inclusions are small. Meanwhile, the surface quality of the steel billet is optimized by grinding the steel billet, and defects such as pits and the decarburized layer on the surface of the steel billet are eliminated. Furthermore, the steel billet is kept in a recrystallization zone for rolling by controlling the start rolling temperature in the high-speed wire rolling process, and the temperature-controlled cooling in the cooling process is combined, so that an excessively high cooling rate in a pearlite phase change process and after the phase change process is avoided, and the formation of a martensite structure due to insufficient phase change time is prevented. The internal stress is reduced, the structure properties are optimized, and the tensile strength and the drawing properties of the wire rod are further enhanced.

(3) The wire rod can be suitable for the production of superfine diamond wire buses with low wire breakage rate and high strength, the diameter of the diamond wire prepared by drawing can be 40 μm to 46 μm, the wire breakage rate is less than or equal to 2 times/thousand kilometers, and the tensile strength is more than or equal to 5000 MPa, so that the wire rod is suitable for manufacturing diamond wires for cutting silicon wafers, the requirements of the market on steel wires with good drawing properties, low wire breakage rate and high strength are greatly met, and the technical blank of wire rods for diamond wires 5000 MPa grade or more at home and abroad is filled.

DETAILED DESCRIPTION

As mentioned in the background, an existing technology for wire rods for high-strength diamond wires is still to be improved and cannot meet the increasingly high requirements of the diamond wires on the diameter, the continuous wire mileage and the strength, and particularly there are still no wire rods suitable for industrially preparing the 5000 MPa-grade diamond wire. Therefore, the present invention is intended to provide a wire rod for deep drawing and a production method therefor, in particular, a hypereutectoid steel wire rod configured to draw to prepare a diamond wire and a production method therefor. The wire rod has the advantages of high purity, good structural uniformity and ultrahigh strength and can be configured to produce of superfine 5000 MPa-grade diamond wires with low wire breakage rate.

The technical solution of the present invention is further described below with reference to specific embodiments, but the scope of protection claimed is not limited to the description.

First Embodiment

This embodiment provides a wire rod for deep drawing, in particular, a wire rod configured to be drawn into a 5000 MPa-grade diamond wire. Of course, it can be understood that the wire rod can be configured to draw into a 5000 MPa-grade diamond wire bus, but is not limited thereto. For example, the wire rod can also be configured to draw into other steel wire products according to the actual production requirements of enterprises.

The wire rod includes the following chemical components in percentage by mass: 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V. The balance of Fe and unavoidable impurities, where the impurities include less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

The core idea of the design of the chemical components of the wire rod in the present invention is to improve the content of pearlite strengthening elements, particularly element C, ensure the controllability of the structure and avoid the formation of high-melting-point inclusions.

Specifically, the design principle of the chemical components of the wire rod is explained as follows.

C: C is the most important constituent element. The content of C can obviously influence the strength of steel and directly influence the organization structure of the steel. In detail, on one hand, an increase in the content of C significantly improves the strength of the steel. On the other hand, in common steel structures, a eutectoid structure formed by C can improve the strength and the strain hardening rate of the steel, but when the content of C is too high, a proeutectoid network cementite structure is formed, and the continuity of the eutectoid structure is damaged by the network cementite structure, so that micro-cracks are formed in the drawing process of a wire rod processed steel wire, and even the wire breakage is caused. Therefore, in the chemical composition design of the present invention, the strength and the strain hardening rate of the steel are improved by increasing the carbon content as much as possible, and the content design of B or V is matched to avoid the appearance of a local network cementite structure, so that the content of C is 1.01% to 1.10%.

Si: Si is a solid solution strengthening element and can also be used for reducing the oxygen content in the steel. However, if the content of Si is too high, the plasticity of the steel may be reduced, the decarburization tendency of the steel billets may be aggravated and the surface quality control of the wire rod is not easy to control. In the present invention, the content of Si is 0.15% to 0.40%.

Mn: Mn is a solid solution strengthening element, can improve the strength of the wire rod and can also be combined with a harmful element S to reduce the hot brittleness of the wire rod. However, if the content of Mn is too high, the hardenability is enhanced, and bainite or martensite which affects drawing may easily occur after the high-speed wire rolling process, which may result in poor plasticity and drawing properties of the wire rod. In the present invention, the content of Mn is 0.30% to 0.60%.

Cr: Cr can refine a pearlite structure (namely, eutectoid structure) and reduce the lamellar spacing of the pearlite structure, so that the strength of the wire rod is improved. However, similar to Mn, if the content of Cr is too high, the hardenability may be improved, and the bainite or martensite which affects drawing may easily occur after the high-speed wire rolling process, which may result in poor plasticity and drawing properties of the wire rod. In the present invention, the content of Cr is 0.01% to 0.40%.

B, V:

With regard to the element B, it participates in the formation of fine carbonitride in high-carbon steel, preferentially partializes on austenite grain boundaries, and is beneficial to hindering the formation of the network cementite structure. However, if the content of B is too high, the grain boundaries may be embrittled, and the drawing properties of the wire rod may be reduced.

With regard to the element V, it is easy to form VC particles on the austenite grain boundaries at an initial phase change stage, the growth of austenite grains during the high-speed wire rolling is inhibited, the content of C on the grain boundaries is reduced, and the formation of the network cementite structure is favorably inhibited. In addition, the element V can precipitate carbonitride in the phase change process, which is beneficial to improving the strength of the wire rod; but when the content of V is too high, quenching structures are easy to appear, and the control of the wire rod structures is not facilitated.

Since both the elements B and V can be used for preventing the formation of the network cementite structure, it is helpful to raise the upper limit of the content of C. Therefore, as mentioned above, the foregoing chemical components of the wire rod include either or both of 0.0005% to 0.0020% of B and 0.01% to 0.09% of V, that is, the following three implementation cases are included: firstly, the chemical components of the wire rod include 0.0005% to 0.0020% of B, but do not contain V, and the formation of the network cementite structure is hindered by using the element B to form fine carbonitride on the austenite grain boundaries; secondly, the chemical components of the wire rod do not include B, but include 0.01% to 0.09% of V, and the formation of the network cementite structure is hindered by using the element V to form the VC particles with the element V at the initial phase change stage and reducing the content of C on the grain boundaries; and thirdly, more preferably, the chemical components of the wire rod include both 0.0005% to 0.0020% of B and 0.01% to 0.09% of V; on one hand, the formation of the network cementite structure is hindered by using the element V to form the VC particles at the initial phase change stage and reducing the content of C on the grain boundaries, and on the other hand, the formation of the network cementite structure is hindered by using the element B to form the fine carbonitride on the austenite grain boundaries.

Al: Al belongs to a harmful element in the wire rod for deep drawing, and Al is combined with O in the steel to form $Al_2O_3$ inclusions with a large size, easiness for agglomeration, a high melting point and poor plasticity, which is one of main reasons for fine wire breakage during the process of drawing the wire rod into the steel wire. In the present invention, the content of Al is not more than 0.003%.

Ti: Ti belongs to a harmful element in the wire rod for deep drawing, and Ti is extremely easy to form large-size angular Ti (C, N) inclusions with C and N, thereby causing stress concentration and creating microcracks. In the present invention, the content of Ti is not more than 0.0008%.

S, P, O, N: S, P, O, N belong to harmful impurity elements, with the respective content of less than or equal to 0.005% of S, less than or equal to 0.008% of P, less than or equal to 0.0010% of O and less than or equal to 0.0020% of N.

Further, the diameter of the wire rod is phi 4.5 mm to phi 5.5 mm, and the wire rod can meet the requirement of preparing the steel wire through drawing.

Further, a tensile strength of the wire rod is more than or equal to 1320 MPa, so that a tensile strength of the further prepared steel wire reaches 5000 MPa or more. The wire rod has excellent drawing properties, a reduction of area is more than or equal to 30%, and the wire breakage rate in the drawing process is ensured to be low.

Further, the wire rod has excellent internal quality and structural uniformity, with the maximum inclusion size of less than or equal to 4 μm and the network carbide of less than or equal to grade 1.0, where the maximum inclusion size is less than or equal to 4 μm, including the maximum inclusion size in the transverse direction being less than or equal to 4 μm and the maximum inclusion size in the longitudinal direction being less than or equal to 4 μm. And further, the detection ratio of the network carbide is less than or equal to 30%, and the central carbon segregation ratio is less than or equal to 1.03. The central carbon segregation ratio refers to the ratio of the carbon content of the most serious segregation region and a matrix position.

Further, the surface crack depth of the wire rod is less than or equal to 30 μm, the depth of a decarburized layer is less than or equal to 40 μm, the proportion of the decarburized layer in the total circumference is less than or equal to 15%, and the thickness of a surface oxide scale is 7 μm to 15 μm.

In conclusion, the wire rod of this embodiment has high purity, structural uniformity, high mechanical properties and high drawing properties, and can meet the requirements of preparing the diamond wire. By adopting the prior art of preparing the diamond wire by using the wire rod, the wire rod of the present invention can be configured to prepare steel wires with the diameter of 40 μm to 46 μm, the wire breaking rate of less than or equal to 2 times/thousand kilometers and the tensile strength of more than or equal to 5000 MPa, thereby greatly meeting the requirements of the market on the steel wires with good drawing properties, low wire breaking rate and high strength.

An embodiment provides a method for producing the wire rod. In this embodiment, the wire rod is prepared by means of sequential processes of vacuum melting→steel ingot remelting→billet making and grinding→high-speed wire rolling→cooling. That is, the production method includes the following processes:

vacuum melting: adding alloy elements into molten iron according to a composition design of 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V, and melting molten steel by adopting a vacuum melting furnace in an atmosphere with a pressure in the furnace below 10 Pa, and casting same into a steel ingot;

steel ingot remelting: processing the steel ingot by means of electroslag remelting under a protective atmosphere to obtain a remelted ingot, chemical components of the remelted ingot including C, Si, Mn, Cr, and either or both of B and V and the balance of Fe and unavoidable impurities, the impurities including elements of less than or equal to 0.003% of Al, less than or equal to 0.0008% of Ti, less than or equal to 0.005% of S, less than or equal to 0.008% of P, less than or equal to 0.0010% of O and less than or equal to 0.0020% of N;

billet making and grinding: cogging or forging the remelted ingot into a steel billet, and grinding the steel billet;

high-speed wire rolling: rolling the steel billet into the wire rod, with an start rolling temperature of 1030° C. to 1060° C., and a finish rolling temperature of 950° C. to 1020° C.; and cooling: carrying out temperature-controlled cooling on the wire rod on a Stelmor cooling line, starting $1^{st}$ to $4^{th}$ fans with air quantities of 80% to 100%, and closing the rest fans.

Therefore, by regulating and controlling the pressure in the furnace in the vacuum melting process, and carrying out the electroslag remelting process under the protective atmosphere, the chemical components in the material are finely controlled, the purity is high, the generation of inclusions is greatly reduced, and the sizes of the inclusions are small. Meanwhile, the surface quality of the steel billet is optimized by grinding the steel billet, and defects such as pits and the decarburized layer on the surface of the steel billet are eliminated. Furthermore, the steel billet is kept in a recrystallization zone for rolling by controlling the start rolling temperature in the high-speed wire rolling process, and the temperature-controlled cooling in the cooling process is combined, so that an excessively high cooling rate in a pearlite phase change process and after the phase change process is avoided, and the formation of a martensite structure due to insufficient phase change time is prevented. The internal stress is reduced, the structure properties are optimized, and the tensile strength and the drawing properties of the wire rod are further enhanced.

Preferred embodiments of the respective processes will be described in detail below.

(1) Vacuum Melting Process

In this vacuum melting process, based on the above-mentioned design concept of the chemical components of the wire rod, the molten steel is melted by adding alloy elements to the molten iron according to a composition design of 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V.

Preferably, raw and auxiliary materials used in the vacuum melting process are high-quality raw and auxiliary materials with low impurity element content. For example, industrial pure iron with less than or equal to 0.001% of Al, less than or equal to 0.0005% of Ti, less than or equal to 0.001% of Cu, and less than or equal to 0.001% of Ni is used as the raw material and the alloy elements are added according to a composition design. That is, the above-mentioned molten iron is prepared by melting the industrial pure iron with less than or equal to 0.001% of Al, less than or equal to 0.0005% of Ti, less than or equal to 0.001% of Cu, and less than or equal to 0.001% of Ni. Of course. The impurity elements in the raw material industrial pure iron of the molten iron are preferably but not necessarily limited to the content above, so that the harmful elements can be fewer and the purity can be higher from the beginning of molten steel melting, which is beneficial to the fine control of subsequent inclusions.

In this vacuum melting process, the molten steel is melted by adopting the vacuum melting furnace in the atmosphere with the pressure in the furnace below 10 Pa, and is cast into the steel ingot. The pressure in the furnace is controlled to be below 10 Pa, that is, the furnace is maintained at a high vacuum degree, thereby avoiding the influence of the elements O and N in the air on the molten steel and being beneficial to controlling the low content of the harmful elements O and N in the molten steel. Further preferably, the pressure in the furnace is controlled to be below 5 Pa.

Preferably, in the vacuum melting process, in the process of casting the molten steel into the steel ingot, a casting temperature is 1580° C. to 1620° C., that is, the molten steel is cast into the ingot when being heated to 1580° C. to 1620° C., and a casting speed is 300 kg/min to 400 kg/min. Therefore, on one hand, the purity of the molten steel can be further ensured, on the other hand, a core solute of the steel ingot can be fully diffused, and the central segregation of the steel ingot is reduced.

(2) Steel Ingot Remelting Process

In this steel ingot remelting process, the steel ingot obtained in the vacuum melting process is processed by means of the electroslag remelting under the protective atmosphere to obtain the remelted ingot. The chemical components of the remelted ingot include C, Si, Mn, Cr, and either or both of B and V and the balance of Fe and unavoidable impurities, and the impurities include elements of less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

That is, by means of the steel ingot remelting process, the strict control of impurity elements (namely harmful elements) in the material is realized by combining the fine control of the vacuum melting process, so that the purity is ensured to be high, the generation of the inclusions is greatly reduced, and the inclusions are small in size and uniform in chemical components.

The electroslag remelting is carried out under the protective atmosphere, so that molten steel can be prevented from being oxidized, and the generation of the inclusions can be reduced. The protective atmosphere specifically can be an atmosphere composed of inert gas, for example, air in an electroslag furnace is exhausted and replaced with the inert gas, and then the steel ingot is remelted.

(3) Billet Making Process and Grinding Process

In this billet making process, the remelted ingot obtained in the steel ingot remelting process is cogged or forged into a steel billet, preferably, the steel billet is a square billet having a length of 9 m to 16 m and a size of 145 mm×145 mm, but the size of the steel billet is not limited thereto and may be any industrially feasible size.

Further preferably, in the billet making process, the remelted ingot is cogged or forged at a temperature of 1130° C. to 1160° C. Therefore, the temperature uniformity of the center and surface of the steel billet can be further ensured, facilitating the improvement of the structure uniformity.

In this grinding process, the steel billet obtained in the billet making process is ground so as to optimize the surface quality of the steel billet, eliminate the defects such as the pits and the decarburized layer on the surface of the steel billet, and further create a good foundation for subsequent high-speed wire rolling.

Preferably, in the grinding process, the total grinding depth on the surface of the steel billet is more than or equal to 1.5 mm. Specifically, 16-mesh, 24-mesh and 30-mesh grinding wheels are sequentially used to grind the surface of the steel billet. The grinding depth of each pass is respectively more than or equal to 0.9 mm, more than or equal to 0.5 mm and more than or equal to 0.1 mm. That is, the grinding depth of the 16-mesh grinding wheel on the surface of the steel billet is more than or equal to 0.9 mm, the grinding depth of the 24-mesh grinding wheel on the surface of the steel billet is more than or equal to 0.5 mm, and the grinding depth of the 30-mesh grinding wheel on the surface of the steel billet is more than or equal to 0.1 mm. In addition, the grinding width of a corner of the steel billet is more than or equal to 5 mm. Specifically, the corner of the steel billet is ground obliquely, and after the corner is ground, the bevel width formed at the corner is the grinding width of the corner. Thus, the surface of the steel billet is ensured to be smooth and burr-free finally by means of the grinding process.

(4) High-Speed Wire Rolling Process

In this high-speed wire rolling process, the steel billet is rolled into the wire rod, a soaking temperature during heating before rolling is adjusted to make the start rolling temperature to be 1030° C. to 1060° C., and the finish rolling temperature is 950° C. to 1020° C. by means of temperature control means such as water cooling in the rolling process, so that the steel billet is basically kept in a recrystallization zone for rolling, the structure of the wire rod is finely controlled, and the bainite, martensite and network cementite structures are avoided.

Preferably, in the high-speed wire rolling process, the steel billet is rolled into the wire rod with a diameter of phi 4.5 mm to phi 5.5 mm, that is, the diameter of the wire rod finally prepared by the production method based on this embodiment is phi 4.5 mm to phi 5.5 mm, and the requirement of preparing the steel wire by drawing can be further met.

Preferably, in this high-speed wire rolling process, a finishing speed is 100 m/s to 110 m/s, so as to further ensure that the steel billet is basically kept in the recrystallization zone for rolling, and a spinning temperature is 890° C. to 920° C., so as to further finely control the wire rod structure and facilitate the temperature control of air cooling.

(5) Cooling Process

In this cooling process, temperature-controlled cooling is carried out on the wire rod on the Stelmor cooling line, the $1^{st}$ to $4^{th}$ fans are started, with air quantities of 80% to 100%, and the rest fans are closed, that is, the Stelmor air cooling technology is adopted to carry out temperature-controlled cooling treatment. A cooling regime of the present invention can avoid an excessively high cooling rate in the pearlite phase change process and after the phase change process, prevent the formation of the martensite structure due to insufficient phase change time, reduce the internal stress, optimize the structure properties, and further enhance the tensile strength and the drawing properties of the wire rod.

Preferably, in the cooling process, all heat preservation covers on the Stelmor cooling line are opened, that is, air cooling is performed on roller way sections corresponding to the first 4 fans, and all roller way sections corresponding to the rest fans are naturally cooled.

Preferably, in front of the $1^{st}$ fan, a running speed of an inlet section of a roller way is 0.9 m/s to 1.0 m/s, the ratio of the running speeds of the roller ways corresponding to the $1^{st}$ to $4^{th}$ fans is 1.10:1.05:1.02:1.00, and the ratio of the running speeds of the roller ways corresponding to the rest fans is 0.8:1.00-1.05:1.00.

In addition, in the cooling process, a wind speed at an overlapping point is adjusted to be 1.1 to 1.4 times of the wind speed at a non-overlapping point by using optitflex, so that the cooling speed balance of the overlapping point and the non-overlapping point is ensured, and the uniform structure properties are further obtained.

Further preferably, the wire rod prepared by the production method can be packed by adopting a packing thread, the packing thread and the wire rod are separated by adopting a flexible wear-resistant material so as to avoid the wire rod from being scratched by the packing thread during transportation, reshipment and storage. Then aging treatment is carried out, where the time for the aging treatment is more than or equal to 10 days when the room temperature is more than or equal to 15° C., and is more than or equal to 20 days when the room temperature is less than 15° C.

Compared with the prior art, an embodiment of the present invention has the following beneficial effects.

(1) By increasing the content of pearlite strengthening elements, particularly element C, matching with addition of B and/or V, and strictly controlling the content of impurity elements, the structural uniformity is ensured, high-melting-point inclusions are prevented from being formed, and the purity, tensile strength and drawing properties are improved.

(2) By regulating and controlling the pressure in the furnace in the vacuum melting process, and carrying out the electroslag remelting process under the protective atmosphere, the chemical components in the material are finely controlled, the purity is high, the generation of inclusions is greatly reduced, and the sizes of the inclusions are small. Meanwhile, the surface quality of the steel billet is optimized by grinding the steel billet, and defects such as the pits and the decarburized layer on the surface of the steel billet are eliminated. Furthermore, the steel billet is kept in the recrystallization zone for rolling by controlling the start rolling temperature in the high-speed wire rolling process, and the temperature-controlled cooling in the cooling process is combined, so that an excessively high cooling rate in the pearlite phase change process and after the phase change process is avoided, and the formation of the martensite structure due to the insufficient phase change time is prevented. The internal stress is reduced, the structure properties are optimized, and the tensile strength and the drawing properties of the wire rod are further enhanced.

(3) The wire rod can be suitable for the production of superfine diamond wires with low wire breakage rate and high strength, the diameter of the diamond wire prepared by drawing can be 40 μm to 46 μm, the wire breakage rate is less than or equal to 2 times/thousand kilometers, and the tensile strength is more than or equal to 5000 MPa, so that the wire rod is suitable for manufacturing diamond wires for cutting silicon wafers, the requirements of the market on steel wires with good drawing properties, low wire breakage rate and high strength are greatly met, and the technical blank of wire rods for diamond wires 5000 MPa grade or more at home and abroad is filled.

Second Embodiment

This embodiment also provides a wire rod for deep drawing, in particular, a wire rod configured to be drawn into a 5000 MPa-grade diamond wire, and provides a method for producing the wire rod. This embodiment differs from the foregoing first embodiment only in the steel ingot remelting process in the production method. In addition, the remaining techniques are the same as those of the foregoing first embodiment. Only differences between this embodiment and the first embodiment will be described below, and the rest of the same parts will not be described again.

In this embodiment, the steel ingot remelting process (2) in the production method is specifically as follows.

In this steel ingot remelting process, the steel ingot is processed by adopting the vacuum arc remelting at a remelting speed of 3.0 kg/min to 3.5 kg/min to obtain the remelted ingot, the chemical components of the remelted ingot include C, Si, Mn, Cr, and either or both of B and V and the balance of Fe and unavoidable impurities, and the impurities include elements of less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

That is, by means of the steel ingot remelting process, the strict control of impurity elements (namely harmful elements) in the material is realized by combining the fine control of the vacuum melting process, so that the purity is ensured to be high, the generation of inclusions is greatly reduced, and the sizes of the inclusions are small. Meanwhile, the types of the inclusions are controlled, so that the chemical components are uniform.

Specifically, in this steel ingot remelting process, the steel ingot obtained in the vacuum melting process is used as an electrode to perform vacuum arc remelting.

Further, in the steel ingot remelting process, heat preservation is performed on the obtained remelted ingot for 48 hours or more after the remelted ingot is obtained by adopting the vacuum arc remelting, so that the stress cracks on the surface and the core of the remelted ingot are further reduced.

In summary, this embodiment is the same as the first embodiment except that the vacuum arc remelting is used in the steel ingot remelting process instead of the electroslag remelting in the first embodiment. Therefore, this embodiment also has the beneficial effects of the foregoing first embodiment, which are not described again.

Third Embodiment

This embodiment also provides a wire rod for deep drawing, in particular, a wire rod configured to be drawn into a 5000 MPa-grade diamond wire, and provides a method for producing the wire rod. This embodiment differs from the foregoing first embodiment only in the steel ingot remelting process in the production method. In addition, the remaining techniques are the same as those of the foregoing first embodiment. Only differences between this embodiment and the first embodiment will be described below, and the rest of the same parts will not be described again.

In this embodiment, the steel ingot remelting process (2) in the production method is specifically as follows.

In this steel ingot remelting process, firstly, the electroslag remelting is carried out on the steel ingot obtained in the vacuum melting process under the protective atmosphere. Then, the remelted ingot obtained by adopting the electroslag remelting is used as the electrode. The vacuum arc remelting is adopted for processing at a remelting speed of 3.0 kg/min to 3.5 kg/min to obtain the remelted ingot. The chemical components of the remelted ingot include C, Si, Mn, Cr, and either or both of B and V and the balance of Fe and unavoidable impurities, and the impurities include elements of less than or equal to 0.003% of Al, less than or equal to 0.0008% of Ti, less than or equal to 0.005% of S, less than or equal to 0.008% of P, less than or equal to 0.0010% of O and less than or equal to 0.0020% of N.

Further, in this embodiment, in the steel ingot remelting process, heat preservation is performed on the obtained remelted ingot for 48 hours or more after the remelted ingot is obtained by adopting the vacuum arc remelting, so that the stress cracks on the surface and the core of the remelted ingot are further reduced.

In summary, the electroslag remelting process in this embodiment is the same as that in the first embodiment, and the vacuum arc remelting is further added on the basis of the first embodiment, so that the impurity elements (namely harmful elements) can be further finely controlled, and the purity and the inclusions can be further ensured. In addition, this embodiment also has the beneficial effects of the foregoing first embodiment, which are not described again.

Of course, in a varied embodiment, the order of the vacuum arc remelting and the electroslag remelting can be interchanged, that is, the vacuum arc remelting is performed first, and then the electroslag remelting is performed.

Fourth Embodiment

This embodiment also provides a wire rod for deep drawing, in particular, a wire rod configured to be drawn into a 5000 MPa-grade diamond wire, and provides a method for producing the wire rod. This embodiment differs from the foregoing first embodiment, second embodiment and third embodiment only in the steel ingot remelting process in that the production method further includes a heat treatment process after the cooling process. In addition, the remaining techniques are the same as those of the foregoing first embodiment, second embodiment, and third embodiment. Hereinafter, only the above differences will be described, and the rest of the same parts will not be described again.

In this embodiment, the production method further includes the following processes.

(6) Heat Treatment Process

Salt bath heat treatment or lead bath heat treatment is carried out on the wire rod cooled on the Stelmor cooling line, where a temperature of an isothermal phase change stage is 520° C. to 560° C. and time is 20 s to 80 s.

As a result, this embodiment provides a wire rod having more uniform structure properties, and higher drawing properties and tensile strength than the foregoing first embodiment, second embodiment and third embodiment.

Several examples of the present invention are provided below to further illustrate the technical solution of the present invention.

Example 1

Example 1 provided a wire rod having a diameter of phi 5.5 mm, which included the following chemical components in percentage by mass: 1.01% of C, 0.30% of Si, 0.60% of Mn, 0.40% of Cr, 0.0013% of B, 0.09% of V, and the balance of Fe and unavoidable impurities, where the impurities included 0.001% of Al, 0.0006% of Ti, 0.003% of S, 0.006% of P, 0.0008% of O, and 0.0012% of N.

The wire rod of this example was subjected to the detection of structure properties, including the followings.

Firstly, 12 samples were taken from each coil of wire rod, and detected respectively to obtain a tensile strength of 1320 MPa to 1350 MPa and a reduction of area of 35% to 40%.

Secondly, 12 samples were taken from each coil of wire rod, the 12 samples included 6 longitudinal section samples and 6 transverse section samples, as shown in Table 1, the maximum surface crack depth, the oxide scale thickness, the maximum inclusion size in the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 1

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 3 | 0 | 0 | 0 | 95 | 25 | 10 | 15 | 1.02 | 8 |
| 2 | 0 | 0 | 0 | 0 | 96 | 22 | 8 | 0 | 1.01 | 8 |

TABLE 1-continued

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 3 | 0 | 0 | 0 | 0 | 95 | 26 | 8 | 0 | 1.01 | 9 |
| 4 | 0 | 0 | 0 | 1 | 95 | 20 | 8 | 0 | 1.00 | 8 |
| 5 | 0 | 0 | 0 | 0 | 96 | 33 | 9 | 0 | 1.00 | 9 |
| 6 | 0 | 0 | 0 | 0 | 95 | 34 | 8 | 10 | 1.02 | 9 |
| 7 | 4 | 0 | 0 | 0 | 96 | 28 | 8 | 0 | 1.00 | 9 |
| 8 | 0 | 0 | 0 | 0 | 95 | 32 | 6 | 0 | 1.00 | 8 |
| 9 | 0 | 0 | 0 | 0 | 95 | 32 | 7 | 0 | 1.00 | 9 |
| 10 | 0 | 3 | 0 | 0 | 96 | 33 | 6 | 0 | 1.01 | 9 |
| 11 | 0 | 0 | 0 | 0 | 96 | 24 | 6 | 0 | 1.00 | 10 |
| 12 | 2 | 0 | 0 | 0 | 97 | 33 | 8 | 0 | 1.00 | 9 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting silicon wafers, and the obtained diamond wire had the tensile strength of 5300 MPa, the diameter of 46 μm, and the wire breakage rate of approximately 1.2 times/thousand kilometers, which were far ahead of those in the prior art.

Example 2

Example 2 provided a wire rod having a diameter of phi 5.0 mm, which included the following chemical components in percentage by mass: 1.03% of C, 0.18% of Si, 0.58% of Mn, 0.36% of Cr, 0.002% of B, and the balance of Fe and unavoidable impurities, where the impurities included 0.001% of Al, 0.0005% of Ti, 0.002% of S, 0.004% of P, 0.001% of O, and 0.0013% of N.

The wire rod of this example was subjected to the detection of structure properties, including the followings.

Firstly, 12 samples were taken from each coil of wire rod, and detected respectively to obtain a tensile strength of 1330 MPa to 1360 MPa and a reduction of area of 33% to 40%.

Secondly, 12 samples were taken from each coil of wire rod, the 12 samples included 6 longitudinal section samples and 6 transverse section samples, as shown in Table 2, the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 2

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 0 | 0 | 0 | 0 | 96 | 30 | 6 | 0 | 1.02 | 9 |
| 2 | 0 | 0 | 0 | 0 | 96 | 32 | 7 | 0 | 1.02 | 9 |
| 3 | 0 | 0 | 0 | 0 | 96 | 30 | 8 | 0 | 1.01 | 11 |
| 4 | 0 | 3 | 0 | 1 | 95 | 21 | 6 | 0 | 1.03 | 10 |
| 5 | 0 | 0 | 0 | 0 | 97 | 32 | 7 | 0 | 1.01 | 9 |
| 6 | 0 | 0 | 0 | 0 | 95 | 33 | 8 | 0 | 1.02 | 10 |
| 7 | 2 | 0 | 0 | 0 | 96 | 24 | 6 | 0 | 1.00 | 11 |
| 8 | 0 | 0 | 0 | 0 | 95 | 25 | 6 | 0 | 1.01 | 10 |
| 9 | 0 | 0 | 0 | 1 | 97 | 30 | 5 | 0 | 1.00 | 9 |
| 10 | 0 | 3 | 0 | 0 | 96 | 30 | 5 | 0 | 1.01 | 9 |
| 11 | 0 | 0 | 0 | 0 | 97 | 21 | 6 | 0 | 1.00 | 10 |
| 12 | 0 | 0 | 0 | 0 | 97 | 32 | 7 | 0 | 1.02 | 11 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 5500 MPa, the diameter of 45 μm, and the wire breakage rate of approximately 1.5 times/thousand kilometers, which were far ahead of those in the prior art.

Example 3

Example 3 provided a wire rod having a diameter of phi 5.5 mm, which included the following chemical components in percentage by mass: 1.03% of C, 0.20% of Si, 0.55% of Mn, 0.22% of Cr, 0.06% of V, and the balance of Fe and unavoidable impurities, where the impurities included 0.002% of Al, 0.0006% of Ti, 0.002% of S, 0.006% of P, 0.0006% of O, and 0.0008% of N.

The wire rod of this example was subjected to the detection of structure properties, including the followings.

Firstly, 12 samples were taken from each coil of wire rod, and detected respectively to obtain a tensile strength of 1320 MPa to 1350 MPa and a reduction of area of 33% to 39%.

Secondly, 12 samples were taken from each coil of wire rod, the 12 samples included 6 longitudinal section samples and 6 transverse section samples, as shown in Table 3, the maximum surface crack depth, the oxide scale thickness, the maximum inclusion size in the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 3

| Sample | Transverse Inclusion Size/ μm | Longitudinal Inclusion Size/μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 0 | 0 | 0 | 0 | 97 | 21 | 11 | 0 | 1.02 | 8 |
| 2 | 0 | 0 | 0 | 0 | 96 | 20 | 10 | 0 | 1.01 | 9 |
| 3 | 0 | 0 | 0 | 0 | 97 | 22 | 8 | 0 | 1.03 | 10 |
| 4 | 2 | 0 | 0 | 1 | 96 | 23 | 9 | 0 | 1.02 | 11 |
| 5 | 0 | 1 | 0 | 0 | 95 | 22 | 9 | 0 | 1.01 | 9 |
| 6 | 0 | 0 | 0 | 0 | 96 | 23 | 9 | 8 | 1.0 | 8 |
| 7 | 0 | 0 | 0 | 0 | 96 | 24 | 10 | 0 | 1.00 | 10 |
| 8 | 0 | 0 | 0 | 0 | 95 | 23 | 6 | 0 | 1.00 | 9 |
| 9 | 2 | 0 | 0 | 0 | 96 | 25 | 9 | 0 | 1.00 | 8 |
| 10 | 0 | 2 | 0 | 0 | 97 | 30 | 8 | 0 | 1.01 | 10 |
| 11 | 0 | 0 | 0 | 0 | 97 | 31 | 6 | 0 | 1.00 | 9 |
| 12 | 0 | 0 | 0 | 0 | 98 | 23 | 7 | 0 | 1.01 | 10 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 5500 MPa, the diameter of 45 μm, and the wire breakage rate of approximately 1.6 times/thousand kilometers, which were far ahead of those in the prior art.

Example 4

Example 4 provided a wire rod having a diameter of phi 4.5 mm, which included the following chemical components in percentage by mass: 1.05% of C, 0.16% of Si, 0.55% of Mn, 0.01% of Cr, 0.0005% of B, 0.04% of V, and the balance of Fe and unavoidable impurities, where the impurities included 0.002% of Al, 0.0003% of Ti, 0.001% of S, 0.003% of P, 0.0003% of O, and 0.0009% of N.

The wire rod of this example was subjected to the detection of structure properties, including the followings.

Firstly, 12 samples were taken from each coil of wire rod, and detected respectively to obtain a tensile strength of 1320 MPa to 1360 MPa and a reduction of area of 32% to 38%.

Secondly, 12 samples were taken from each coil of wire rod, the 12 samples included 6 longitudinal section samples and 6 transverse section samples, as shown in Table 4, the maximum surface crack depth, the oxide scale thickness, the maximum inclusion size in the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 4

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 0 | 0 | 0 | 0 | 97 | 22 | 5 | 0 | 1.03 | 11 |
| 2 | 0 | 0 | 0 | 1 | 96 | 21 | 5 | 0 | 1.02 | 11 |
| 3 | 3 | 0 | 0 | 0 | 97 | 20 | 7 | 0 | 1.01 | 12 |
| 4 | 0 | 2 | 0 | 0 | 95 | 24 | 6 | 0 | 1.03 | 10 |
| 5 | 0 | 0 | 0 | 0 | 98 | 23 | 7 | 10 | 1.01 | 9 |
| 6 | 0 | 0 | 0 | 0 | 95 | 23 | 6 | 0 | 1.02 | 10 |
| 7 | 0 | 3 | 0 | 0 | 96 | 24 | 6 | 0 | 1.01 | 11 |
| 8 | 0 | 0 | 0 | 0 | 98 | 24 | 5 | 0 | 1.01 | 11 |
| 9 | 0 | 0 | 0 | 1 | 97 | 22 | 5 | 0 | 1.00 | 9 |

TABLE 4-continued

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 10 | 0 | 0 | 0 | 0 | 98 | 22 | 8 | 0 | 1.01 | 10 |
| 11 | 0 | 0 | 0 | 0 | 97 | 23 | 6 | 0 | 1.00 | 10 |
| 12 | 0 | 0 | 0 | 0 | 98 | 22 | 7 | 0 | 1.02 | 11 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 5500 MPa, the diameter of 40 μm, and the wire breakage rate of approximately 1.8 times/thousand kilometers, which were far ahead of those in the prior art.

Example 5

Example 5 provided a wire rod having a diameter of phi 5.5 mm, which included the following chemical components in percentage by mass: 1.05% of C, 0.22% of Si, 0.45% of Mn, 0.19% of Cr, 0.001% of B, and the balance of Fe and unavoidable impurities, where the impurities included 0.001% of Al, 0.0002% of Ti, 0.003% of S, 0.004% of P, 0.0005% of O, and 0.001% of N.

The wire rod of this example was subjected to the detection of structure properties, including the followings.

Firstly, 12 samples were taken from each coil of wire rod, and detected respectively to obtain a tensile strength of 1340 MPa to 1380 MPa and a reduction of area of 30% to 38%.

Secondly, 12 samples were taken from each coil of wire rod, the 12 samples included 6 longitudinal section samples and 6 transverse section samples, as shown in Table 5, the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 5

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 2 | 0 | 0 | 1 | 98 | 16 | 11 | 12 | 1.02 | 10 |
| 2 | 0 | 0 | 0 | 0 | 98 | 25 | 8 | 0 | 1.01 | 11 |
| 3 | 0 | 0 | 0 | 0 | 95 | 18 | 10 | 0 | 1.01 | 9 |
| 4 | 3 | 3 | 0 | 0 | 97 | 16 | 8 | 0 | 1.03 | 12 |
| 5 | 0 | 0 | 0 | 0 | 96 | 18 | 9 | 0 | 1.00 | 9 |
| 6 | 0 | 0 | 0 | 0 | 97 | 24 | 9 | 0 | 1.02 | 10 |
| 7 | 2 | 0 | 0 | 1 | 96 | 18 | 10 | 0 | 1.00 | 9 |
| 8 | 0 | 0 | 0 | 0 | 95 | 12 | 6 | 0 | 1.02 | 10 |
| 9 | 0 | 0 | 0 | 0 | 96 | 16 | 10 | 12 | 1.00 | 9 |
| 10 | 0 | 0 | 0 | 0 | 96 | 24 | 6 | 0 | 1.01 | 11 |
| 11 | 0 | 0 | 0 | 0 | 97 | 14 | 11 | 0 | 1.02 | 10 |
| 12 | 0 | 0 | 0 | 0 | 97 | 25 | 8 | 0 | 1.01 | 9 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 6100 MPa, the diameter of 40 μm, and the wire breakage rate of approximately 1.9 times/thousand kilometers, which were far ahead of those in the prior art.

Example 6

Example 6 provided a wire rod having a diameter of phi 5.0 mm, which included the following chemical components in percentage by mass: 1.08% of C, 0.25% of Si, 0.32% of Mn, 0.18% of Cr, 0.01% of V, and the balance of Fe and unavoidable impurities, where the impurities included 0.001% of Al, 0.0005% of Ti, 0.001% of S, 0.003% of P, 0.0004% of O, and 0.0006% of N.

The wire rod of this example was subjected to the detection of structure properties, including the followings.

Firstly, 12 samples were taken from each coil of wire rod, and detected respectively to obtain a tensile strength of 1350 MPa to 1400 MPa and a reduction of area of 30% to 38%.

Secondly, 12 samples were taken from each coil of wire rod, the 12 samples included 6 longitudinal section samples and 6 transverse section samples, as shown in Table 6, the maximum surface crack depth, the oxide scale thickness, the maximum inclusion size in the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 6

| Sample | Transverse Inclusion Size/ μm | Longitudinal Inclusion Size/ μm | Titanium Inclusion/ μm | Network Carbide Grade/ grade | Sorbitizing Rate/% | Depth of Decarburize Layer μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 0 | 0 | 0 | 0 | 98 | 21 | 9 | 0 | 1.03 | 12 |
| 2 | 0 | 0 | 0 | 0 | 98 | 20 | 10 | 12 | 1.01 | 11 |
| 3 | 0 | 0 | 0 | 0 | 99 | 22 | 9 | 0 | 1.03 | 10 |
| 4 | 0 | 0 | 0 | 0 | 98 | 28 | 11 | 0 | 1.02 | 12 |
| 5 | 3 | 0 | 0 | 0 | 99 | 28 | 10 | 0 | 1.01 | 9 |
| 6 | 0 | 3 | 0 | 0 | 98 | 32 | 9 | 11 | 1.01 | 12 |
| 7 | 0 | 0 | 0 | 0 | 99 | 19 | 8 | 0 | 1.00 | 10 |
| 8 | 0 | 0 | 0 | 0 | 98 | 28 | 9 | 0 | 1.01 | 11 |
| 9 | 0 | 2 | 0 | 0 | 99 | 30 | 7 | 0 | 1.01 | 9 |
| 10 | 0 | 0 | 0 | 0 | 99 | 33 | 8 | 0 | 1.01 | 12 |
| 11 | 2 | 0 | 0 | 0 | 99 | 30 | 9 | 0 | 1.00 | 11 |
| 12 | 0 | 0 | 0 | 0 | 98 | 22 | 7 | 0 | 1.01 | 11 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 6400 MPa, the diameter of 45 μm, and the wire breakage rate of approximately 1.9 times/thousand kilometers, which were far ahead of those in the prior art.

Example 7

Example 7 provided a wire rod having a diameter of phi 5.5 mm, which included the following chemical components in percentage by mass: 1.10% of C, 0.16% of Si, 0.30% of Mn, 0.15% of Cr, 0.05% of V, and the balance of Fe and unavoidable impurities, where the impurities included 0.001% of Al, 0.0002% of Ti, 0.002% of S, 0.003% of P, 0.0002% of O, and 0.0009% of N.

The wire rod of this example was subjected to the detection of structure properties, including the followings.

Firstly, 12 samples were taken from each coil of wire rod, and detected respectively to obtain a tensile strength of 1340 MPa to 1390 MPa and a reduction of area of 32% to 38%.

Secondly, 12 samples were taken from each coil of wire rod, the 12 samples included 6 longitudinal section samples and 6 transverse section samples, as shown in Table 7, the maximum surface crack depth, the oxide scale thickness, the maximum inclusion size in the transverse direction (abbreviated as transverse inclusion size in the table), the maximum inclusion size in the longitudinal direction (abbreviated as longitudinal inclusion size in the table) and the grade of network carbides (abbreviated as network carbide grade in the table) of each sample were observed and measured by using a metallographic microscope after grinding and polishing, the central carbon segregation ratio was detected and analyzed by using an electron probe, and the maximum depth of a decarburized layer and the proportion of the decarburized layer in the total circumference (abbreviated as decarburizing ratio in the table) were observed after each sample was corroded.

TABLE 7

| Sample | Transverse Inclusion Size/ μm | Longitudinal Inclusion Size/ μm | Titanium Inclusion/ μm | Network Carbide Grade/ grade | Sorbitizing Rate/% | Depth of Decarburized Layer/ μm | Decarburizing Ratio | Surface Crack Depth/ μm | Central Carbon Segregation Ratio | Oxide Scale Thickness/ μm |
|---|---|---|---|---|---|---|---|---|---|---|
| 1 | 0 | 0 | 0 | 0 | 99 | 21 | 11 | 0 | 1.02 | 11 |
| 2 | 2 | 0 | 0 | 0 | 99 | 25 | 10 | 10 | 1.01 | 13 |
| 3 | 0 | 2 | 0 | 0 | 99 | 22 | 12 | 0 | 1.03 | 11 |
| 4 | 0 | 0 | 0 | 0 | 99 | 30 | 11 | 0 | 1.03 | 13 |
| 5 | 2 | 0 | 0 | 0 | 99 | 28 | 10 | 0 | 1.01 | 9 |
| 6 | 0 | 3 | 0 | 0 | 99 | 23 | 9 | 0 | 1.01 | 10 |
| 7 | 0 | 0 | 0 | 0 | 99 | 19 | 12 | 0 | 1.02 | 10 |
| 8 | 0 | 0 | 0 | 0 | 98 | 28 | 9 | 12 | 1.01 | 9 |
| 9 | 3 | 2 | 0 | 0 | 99 | 31 | 7 | 0 | 1.01 | 9 |
| 10 | 0 | 0 | 0 | 0 | 99 | 31 | 12 | 0 | 1.01 | 12 |
| 11 | 0 | 0 | 0 | 0 | 99 | 30 | 9 | 0 | 1.02 | 9 |
| 12 | 0 | 0 | 0 | 0 | 98 | 29 | 10 | 0 | 1.01 | 11 |

It could be seen therefrom that the wire rod of this example had high purity, structural uniformity, high tensile strength and good drawing properties, and could meet high requirements of the market on wire rods for deep drawing. Further, the wire rod of this example was used as a base material, an existing process for preparing a diamond wire was adopted to prepare a diamond wire bus for cutting the silicon wafers, and the obtained diamond wire had the tensile strength of 6000 MPa, the diameter of 46 μm, and the wire breakage rate of approximately 2.0 times/thousand kilometers, which were far ahead of those in the prior art.

Example 8

This Example 8 provided a method for producing the wire rod of Example 1, which specifically included the following respective processes.

(1) Vacuum Melting Process

Industrial pure iron with less than or equal to 0.001% of Al, less than or equal to 0.0005% of Ti, less than or equal to 0.001% of Cu, and less than or equal to 0.001% of Ni was used as a raw material and alloy elements were added into molten iron according to a composition design of 1.01% to 1.10% of C, 0.15% to 0.40% of Si, 0.30% to 0.60% of Mn, 0.01% to 0.40% of Cr, 0.0005% to 0.0020% of B and 0.01% to 0.09% of V; and the pressure inside a vacuum melting furnace was kept at 5 Pa to prepare molten steel.

The melted molten steel was to heated to 1580° C. to 1600° C., and protective casting was carried out in inert gas atmosphere to form an ingot, with a casting speed of 370 kg/min.

(2) Steel Ingot Remelting Process

Firstly, electroslag remelting was carried out on the steel ingot obtained in the vacuum melting process under the inert gas atmosphere. Then, a remelted ingot obtained by electroslag remelting was used as an electrode, and vacuum arc remelting was adopted for processing at a remelting speed of 3.2 kg/min to obtain the remelted ingot. Thereafter, heat preservation was carried out on the obtained remelted ingot for 60 hours.

Upon detection, the obtained remelted ingot included the following chemical components in percentage by mass: 1.01% of C, 0.30% of Si, 0.60% of Mn, 0.40% of Cr, 0.0013% of B, 0.09% of V, and the balance of Fe and unavoidable impurities, where the impurities included 0.001% of Al, 0.0006% of Ti, 0.003% of S, 0.006% of P, 0.0008% of O, and 0.0012% of N.

(3) Billet Making Process and Grinding Process

The remelted ingot obtained in the steel ingot remelting process was forged into a square steel billet having a length of 12 m and a size of 145 mm×145 mm at a temperature of 1150° C. Then, the surface of the steel billet was ground by using 16-mesh, 24-mesh and 30-mesh grinding wheels in sequence, where the grinding depth of the 16-mesh grinding wheel on the surface of the steel billet was approximately 1 mm, the grinding depth of the 24-mesh grinding wheel on the surface of the steel billet was approximately 0.6 mm, the grinding depth of the 30-mesh grinding wheel on the surface of the steel billet was approximately 0.2 mm, the total grinding depth of one surface was approximately 1.8 mm (the total grinding depth of two opposite surfaces was approximately 3.6 mm), the grinding width of a corner was 6 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.5 mm, a soaking temperature during heating before rolling was adjusted to make an start rolling temperature to be 1030° C. to 1050° C., and a finish rolling temperature was 980° C. to 1020° C. by means of temperature control means such as water cooling in the rolling process, so that the steel billet was basically kept in a recrystallization zone for rolling.

A finishing speed was 105 m/s and a spinning temperature was 890° C. to 910° C.

(5) Cooling Process

Temperature-controlled cooling was carried out on the wire rod on a Stelmor cooling line, and $1^{st}$ to $4^{th}$ fans were started, with air quantities of 100%, 100%, 100% and 90%, respectively; and the rest fans were closed and all heat preservation covers on the Stelmor cooling line were opened.

In front of the $1^{st}$ fan, a running speed of an inlet section of a roller way was 0.9 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.25 times of the wind speed at a non-overlapping point by using optitflex, so that the cooling speed balance of the overlapping point and the non-overlapping point was ensured.

By using the production method of this example, the wire rod of Example 1 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 25° C., the time of natural aging treatment was 12 days, and then the wire rod was sent to a user for drawing to prepare a steel wire. In the transportation and reshipment processes, a mode using a rubber pad was used for avoiding the scratches of the wire rod.

Example 9

This Example 9 provided a method for producing the wire rod of Example 2, which specifically included the following respective processes.

(1) Vacuum Melting Process

Industrial pure iron with low content of impurity elements was used as a raw material and alloy elements were added into molten iron according to a composition design of 1.01% to 1.10% of C, 0.15% to 0.40% of Si, 0.30% to 0.60% of Mn, 0.01% to 0.40% of Cr, and 0.0005% to 0.0020% of B; and the pressure inside a vacuum melting furnace was kept at 6 Pa to prepare molten steel.

The melted molten steel was to heated to 1600° C. to 1620° C., and protective casting was carried out in an inert gas atmosphere to form an ingot, with a casting speed of 360 kg/min.

(2) Steel Ingot Remelting Process

The steel ingot obtained in the vacuum melting process was used as an electrode, vacuum arc remelting was adopted for processing at a remelting speed of 3.5 kg/min to obtain a remelted ingot. Thereafter, heat preservation was carried out on the obtained remelted ingot for 72 hours, and then wind shielding and stacking cooling were carried out.

Upon detection, the obtained remelted ingot included the following chemical components in percentage by mass: 1.03% of C, 0.18% of Si, 0.58% of Mn, 0.36% of Cr, 0.002% of B, and the balance of Fe and unavoidable impurities, where the impurities included 0.001% of Al, 0.0005% of Ti, 0.002% of S, 0.004% of P, 0.001% of O, and 0.0013% of N.

(3) Billet Making Process and Grinding Process

The remelted ingot obtained in the steel ingot remelting process was forged into a square steel billet having a length of 13 m and a size of 145 mm×145 mm at a temperature of 1130° C. Then, the surface of the steel billet was ground by using 16-mesh, 24-mesh and 30-mesh grinding wheels in sequence, where the grinding depth of the 16-mesh grinding wheel on the surface of the steel billet was approximately 1.2 mm, the grinding depth of the 24-mesh grinding wheel on the surface of the steel billet was approximately 0.5 mm, the grinding depth of the 30-mesh grinding wheel on the surface of the steel billet was approximately 0.3 mm, the total grinding depth of one surface was approximately 2 mm (the total grinding depth of two opposite surfaces was approximately 4 mm), the grinding width of a corner was 9 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.0 mm, a soaking temperature during heating before rolling was adjusted to make an start rolling temperature to be 1040° C. to 1060° C., and a finish rolling temperature was 960° C. to 1010° C. by means of temperature control means such as water cooling in the rolling process, so that the steel billet was basically kept in a recrystallization zone for rolling.

A finishing speed was 103 m/s and a spinning temperature was 900° C. to 920° C.

(5) Cooling Process

Temperature-controlled cooling was carried out on the wire rod on a Stelmor cooling line, and $1^{st}$ to $4^{th}$ fans were started, with air quantities of 100%, 100%, 90% and 90%, respectively; and the rest fans were closed and all heat preservation covers on the Stelmor cooling line were opened.

In front of the $1^{st}$ fan, a running speed of an inlet section of a roller way was 0.85 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.3 times of the wind speed at a non-overlapping point by using optitflex, so that the cooling speed balance of the overlapping point and the non-overlapping point was ensured.

By using the production method of this example, the wire rod of Example 2 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 30° C., the time of natural aging treatment was 10 days, and then the wire rod was sent to a user for drawing to prepare a steel wire. In the transportation and reshipment processes, a mode using a rubber pad was used for avoiding the scratches of the wire rod.

Example 10

This Example 10 provided a method for producing the wire rod of Example 3, which specifically included the following respective processes.

(1) Vacuum Melting Process

Industrial pure iron with less than or equal to 0.001% of Al, less than or equal to 0.0005% of Ti, less than or equal to 0.001% of Cu, and less than or equal to 0.001% of Ni was used as a raw material and alloy elements were added into molten iron according to a composition design of 1.01% to 1.10% of C, 0.15% to 0.40% of Si, 0.30% to 0.60% of Mn, 0.01% to 0.40% of Cr, and 0.01% to 0.09% of V; and the pressure inside a vacuum melting furnace was kept at 5 Pa to prepare molten steel.

The melted molten steel was to heated to 1600° C. to 1620° C., and protective casting was carried out in an inert gas atmosphere to form an ingot, with a casting speed of 330 kg/min.

(2) Steel Ingot Remelting Process

The steel ingot obtained in the vacuum melting process was used as an electrode, vacuum arc remelting was adopted for processing at a remelting speed of 3.0 kg/min to obtain a remelted ingot. Thereafter, heat preservation was carried out on the obtained remelted ingot for 72 hours, and then wind shielding and stacking cooling were carried out.

Upon detection, the obtained remelted ingot included the following chemical components in percentage by mass: 1.03% of C, 0.20% of Si, 0.55% of Mn, 0.22% of Cr, 0.06% of V, and the balance of Fe and unavoidable impurities, where the impurities included 0.002% of Al, 0.0006% of Ti, 0.002% of S, 0.006% of P, 0.0006% of O, and 0.0008% of N.

(3) Billet Making Process and Grinding Process

The remelted ingot obtained in the steel ingot remelting process was subjected to continuous rolling type cogging to prepare a square steel billet having a length of 15 m and a size of 145 mm×145 mm at a temperature of 1130° C. Then, the surface of the steel billet was ground by using 16-mesh, 24-mesh and 30-mesh grinding wheels in sequence, where the grinding depth of the 16-mesh grinding wheel on the surface of the steel billet was approximately 1.1 mm, the grinding depth of the 24-mesh grinding wheel on the surface of the steel billet was approximately 0.7 mm, the grinding depth of the 30-mesh grinding wheel on the surface of the steel billet was approximately 0.2 mm, the total grinding depth of one surface was approximately 2 mm (the total grinding depth of two opposite surfaces was approximately 4 mm), the grinding width of a corner was 6 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.5 mm, a soaking temperature during heating before rolling was adjusted to make an start rolling temperature to be 1040° C. to 1060° C., and a finish rolling temperature was 1000° C. to 1020° C. by means of temperature control means such as water cooling in the rolling process, so that the steel billet was basically kept in a recrystallization zone for rolling.

A finishing speed was 108 m/s and a spinning temperature was 890° C. to 910° C.

(5) Cooling Process

Temperature-controlled cooling was carried out on the wire rod on a Stelmor cooling line, and $1^{st}$ to $4^{th}$ fans were started, with air quantities of 100%, 100%, 95% and 95%, respectively; and the rest fans were closed and all heat preservation covers on the Stelmor cooling line were opened.

In front of the $1^{st}$ fan, a running speed of an inlet section of a roller way was 1.0 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.3 times of the wind speed at a non-overlapping point by using optitflex, so that the cooling speed balance of the overlapping point and the non-overlapping point was ensured.

By using the production method of this example, the wire rod of Example 3 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 10° C., the time of natural aging treatment was 21 days, and then the wire rod was sent to a user for drawing to prepare a steel wire. In the transportation and reshipment processes, a mode using a rubber pad was used for avoiding the scratches of the wire rod.

Example 11

This Example 11 provided a method for producing the wire rod of Example 4, which specifically included the following respective processes.

(1) Vacuum Melting Process

Industrial pure iron with less than or equal to 0.001% of Al, less than or equal to 0.0005% of Ti, less than or equal to 0.001% of Cu, and less than or equal to 0.001% of Ni was used as a raw material and alloy elements were added into molten iron according to a composition design of 1.01% to 1.10% of C, 0.15% to 0.40% of Si, 0.30% to 0.60% of Mn, 0.01% to 0.40% of Cr, 0.0005% to 0.0020% of B and 0.01% to 0.09% of V; and the pressure inside a vacuum melting furnace was kept at 6 Pa to prepare molten steel.

The melted molten steel was to heated to 1600° C. to 1620° C., and protective casting was carried out in an inert gas atmosphere to form an ingot, with a casting speed of 350 kg/min.

(2) Steel Ingot Remelting Process

The steel ingot obtained in the vacuum melting process was used as an electrode, vacuum arc remelting was adopted for processing at a remelting speed of 3.3 kg/min to obtain a remelted ingot. Thereafter, heat preservation was carried out on the obtained remelted ingot for 72 hours, and then wind shielding and stacking cooling were carried out.

Upon detection, the obtained remelted ingot included the following chemical components in percentage by mass: 1.05% of C, 0.16% of Si, 0.55% of Mn, 0.01% of Cr, 0.0005% of B, 0.04% of V, and the balance of Fe and unavoidable impurities, where the impurities included 0.002% of Al, 0.0003% of Ti, 0.001% of S, 0.003% of P, 0.0003% of O, and 0.0009% of N.

(3) Billet Making Process and Grinding Process

The remelted ingot obtained in the steel ingot remelting process was forged into a square steel billet having a length of 14 m and a size of 145 mm×145 mm at a temperature of 1130° C. and then, the surface of the steel billet was ground by using 16-mesh, 24-mesh and 30-mesh grinding wheels in sequence, where the grinding depth of the 16-mesh grinding wheel on the surface of the steel billet was approximately 1.2 mm, the grinding depth of the 24-mesh grinding wheel on the surface of the steel billet was approximately 0.5 mm, the grinding depth of the 30-mesh grinding wheel on the surface of the steel billet was approximately 0.2 mm, the total grinding depth of one surface was approximately 1.9 mm (the total grinding depth of two opposite surfaces was approximately 3.8 mm), the grinding width of a corner was 8 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 4.5 mm, a soaking temperature during heating before rolling was adjusted to make an start rolling temperature to be 1050° C. to 1060° C., and a finish rolling temperature was 980° C. to 1010° C. by means of temperature control means such as water cooling in the rolling process, so that the steel billet was basically kept in a recrystallization zone for rolling.

A finishing speed was 110 m/s and a spinning temperature was 900° C. to 920° C.

(5) Cooling Process

Temperature-controlled cooling was carried out on the wire rod on a Stelmor cooling line, and $1^{st}$ to $4^{th}$ fans were started, with air quantities of 100%, 100%, 85% and 80%, respectively; and the rest fans were closed and all heat preservation covers on the Stelmor cooling line were opened.

In front of the $1^{st}$ fan, a running speed of an inlet section of a roller way was 0.93 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.25 times of the wind speed at a non-overlapping point by using optitflex, so that the cooling speed balance of the overlapping point and the non-overlapping point was ensured.

By using the production method of this example, the wire rod of Example 4 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 32° C., the time of natural aging treatment was 11 days, and then the wire rod was sent to a user for drawing to prepare a steel wire. In the transportation and reshipment processes, a mode using a rubber pad was used for avoiding the scratches of the wire rod.

Example 12

This Example 12 provided a method for producing the wire rod of Example 5, which specifically included the following respective processes.

(1) Vacuum Melting Process

Industrial pure iron was used as a raw material and alloy elements were added into molten iron according to a composition design of 1.01% to 1.10% of C, 0.15% to 0.40% of Si, 0.30% to 0.60% of Mn, 0.01% to 0.40% of Cr, and 0.0005% to 0.0020% of B; and the pressure inside a vacuum melting furnace was kept at 8 Pa to prepare molten steel.

The melted molten steel was to heated to 1580° C. to 1600° C., and protective casting was carried out in inert gas atmosphere to form an ingot, with a casting speed of 320 kg/min.

(2) Steel Ingot Remelting Process

Firstly, electroslag remelting was carried out on the steel ingot obtained in the vacuum melting process under the inert gas atmosphere. Then, a remelted ingot obtained by electroslag remelting was used as an electrode, and vacuum arc remelting was adopted for processing at a remelting speed of 3.3 kg/min to obtain the remelted ingot. Thereafter, heat preservation was carried out on the obtained remelted ingot for 72 hours.

Upon detection, the obtained remelted ingot included the following chemical components in percentage by mass: 1.05% of C, 0.22% of Si, 0.45% of Mn, 0.19% of Cr, 0.001% of B, and the balance of Fe and unavoidable impurities, where the impurities included 0.001% of Al, 0.0002% of Ti, 0.003% of S, 0.004% of P, 0.0005% of O, and 0.001% of N.

(3) Billet Making Process and Grinding Process

The remelted ingot obtained in the steel ingot remelting process was forged into a square steel billet having a length of 10 m and a size of 145 mm×145 mm at a temperature of 1140° C. Then, the surface of the steel billet was ground by using 16-mesh, 24-mesh and 30-mesh grinding wheels in sequence, where the grinding depth of the 16-mesh grinding wheel on the surface of the steel billet was approximately 1.4 mm, the grinding depth of the 24-mesh grinding wheel on the surface of the steel billet was approximately 0.5 mm, the grinding depth of the 30-mesh grinding wheel on the surface of the steel billet was approximately 0.1 mm, the total grinding depth of one surface was approximately 2.0 mm (the total grinding depth of two opposite surfaces was approximately 4.0 mm), the grinding width of a corner was 8 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.5 mm, a soaking temperature during heating before rolling was adjusted to make an start rolling temperature to be 1040° C. to 1060° C., and a finish rolling temperature was 980° C. to 1020° C. by means of temperature control means such as water cooling in the rolling process, so that the steel billet was basically kept in a recrystallization zone for rolling.

A finishing speed was 110 m/s and a spinning temperature was 890° C. to 910° C.

(5) Cooling Process

Temperature-controlled cooling was carried out on the wire rod on a Stelmor cooling line, and $1^{st}$ to $4^{th}$ fans were started, with air quantities of 100%, 100%, 100% and 100%, respectively; and the rest fans were closed and all heat preservation covers on the Stelmor cooling line were opened.

In front of the $1^{st}$ fan, a running speed of an inlet section of a roller way was 1.0 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.28 times of the wind speed at a non-overlapping point by using optitflex, so that the cooling speed balance of the overlapping point and the non-overlapping point was ensured.

By using the production method of this example, the wire rod of Example 5 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 28° C., the time of natural aging treatment was 11 days, and then the wire rod was sent to a user for drawing to prepare a steel wire. In the transportation and reshipment processes, a mode using a rubber pad was used for avoiding the scratches of the wire rod.

Example 13

This Example 13 provided a method for producing the wire rod of Example 6, which specifically included the following respective processes.

(1) Vacuum Melting Process

Industrial pure iron with low content of impurity elements such as Al, Ti, Cu and Ni was used as a raw material and alloy elements were added into molten iron according to a composition design of 1.01% to 1.10% of C, 0.15% to 0.40% of Si, 0.30% to 0.60% of Mn, 0.01% to 0.40% of Cr, and 0.01% to 0.09% of V; and the pressure inside a vacuum melting furnace was kept at 8 Pa to prepare molten steel.

The melted molten steel was to heated to 1600° C. to 1610° C., and protective casting was carried out in an inert gas atmosphere to form an ingot, with a casting speed of 350 kg/min.

(2) Steel Ingot Remelting Process

The steel ingot obtained in the vacuum melting process was used as an electrode, vacuum arc remelting was adopted for processing at a remelting speed of 3.4 kg/min to obtain a remelted ingot. Thereafter, heat preservation was carried out on the obtained remelted ingot for 72 hours, and then wind shielding and stacking cooling were carried out.

Upon detection, the obtained remelted ingot included the following chemical components in percentage by mass: 1.08% of C, 0.25% of Si, 0.32% of Mn, 0.18% of Cr, 0.01% of V, and the balance of Fe and unavoidable impurities, where the impurities included 0.001% of Al, 0.0005% of Ti, 0.001% of S, 0.003% of P, 0.0004% of O, and 0.0006% of N.

(3) Billet Making Process and Grinding Process

The remelted ingot obtained in the steel ingot remelting process was subjected to continuous rolling type cogging to prepare a square steel billet having a length of 14 m and a size of 145 mm×145 mm at a temperature of 1130° C. Then, the surface of the steel billet was ground by using 16-mesh, 24-mesh and 30-mesh grinding wheels in sequence, where the grinding depth of the 16-mesh grinding wheel on the surface of the steel billet was approximately 1.1 mm, the grinding depth of the 24-mesh grinding wheel on the surface of the steel billet was approximately 0.7 mm, the grinding depth of the 30-mesh grinding wheel on the surface of the steel billet was approximately 0.2 mm, the total grinding depth of one surface was approximately 2 mm (the total grinding depth of two opposite surfaces was approximately 4 mm), the grinding width of a corner was 6 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.0 mm, a soaking temperature during heating before rolling was adjusted to make an start rolling temperature to be 1040° C. to 1060° C., and a finish rolling temperature was 1000° C. to 1020° C. by means of temperature control means such as water cooling in the rolling process, so that the steel billet was basically kept in a recrystallization zone for rolling.

A finishing speed was 110 m/s and a spinning temperature was 890° C. to 910° C.

(5) Cooling Process

Temperature-controlled cooling was carried out on the wire rod on a Stelmor cooling line, and $1^{st}$ to $4^{th}$ fans were started, with air quantities of 100%, 100%, 95% and 95%, respectively; and the rest fans were closed and all heat preservation covers on the Stelmor cooling line were opened.

In front of the $1^{st}$ fan, a running speed of an inlet section of a roller way was 1.0 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.2 times of the wind speed at a non-overlapping point by using optitflex, so that the cooling speed balance of the overlapping point and the non-overlapping point was ensured.

(6) Heat Treatment Process

Offline salt bath heat treatment (alternatively, lead bath heat treatment) was carried out on the wire rod cooled on the Stelmor cooling line, where a temperature of an isothermal phase change stage was 540° C. to 560° C. and the time was 70 s.

By using the production method of this example, the wire rod of Example 6 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 5° C., the time of natural aging treatment was 23 days, and then the wire rod was sent to a user for drawing to prepare a steel wire. In the transportation and reshipment processes, a mode using a rubber pad was used for avoiding the scratches of the wire rod.

Example 14

This Example 14 provided a method for producing the wire rod of Example 7, which specifically included the following respective processes.

(1) Vacuum Melting Process

Industrial pure iron with less than or equal to 0.001% of Al, less than or equal to 0.0005% of Ti, less than or equal to 0.001% of Cu, and less than or equal to 0.001% of Ni was used as a raw material and alloy elements were added into molten iron according to a composition design of 1.01% to 1.10% of C, 0.15% to 0.40% of Si, 0.30% to 0.60% of Mn, 0.01% to 0.40% of Cr, and 0.01% to 0.09% of V; and the pressure inside a vacuum melting furnace was kept at 6 Pa to prepare molten steel.

The melted molten steel was to heated to 1590° C. to 1600° C., and protective casting was carried out in an inert gas atmosphere to form an ingot, with a casting speed of 330 kg/min.

(2) Steel Ingot Remelting Process

The steel ingot obtained in the vacuum melting process was used as an electrode, vacuum arc remelting was adopted for processing at a remelting speed of 3.5 kg/min to obtain a remelted ingot. Thereafter, heat preservation was carried out on the obtained remelted ingot for 72 hours, and then wind shielding and stacking cooling were carried out.

Upon detection, the obtained remelted ingot included the following chemical components in percentage by mass: 1.10% of C, 0.16% of Si, 0.30% of Mn, 0.15% of Cr, 0.05% of V, and the balance of Fe and unavoidable impurities, where the impurities included 0.001% of Al, 0.0002% of Ti, 0.002% of S, 0.003% of P, 0.0002% of O, and 0.0009% of N.

(3) Billet Making Process and Grinding Process

The remelted ingot obtained in the steel ingot remelting process was forged into a square steel billet having a length of 10 m and a size of 145 mm×145 mm at a temperature of 1150° C. Then, the surface of the steel billet was ground by using 16-mesh, 24-mesh and 30-mesh grinding wheels in sequence, where the grinding depth of the 16-mesh grinding wheel on the surface of the steel billet was approximately 1.1 mm, the grinding depth of the 24-mesh grinding wheel on the surface of the steel billet was approximately 0.7 mm, the grinding depth of the 30-mesh grinding wheel on the surface of the steel billet was approximately 0.2 mm, the total grinding depth of one surface was approximately 2 mm (the total grinding depth of two opposite surfaces was approximately 4 mm), the grinding width of a corner was 8 mm, and the surface of the steel billet after grinding was smooth and free of burrs.

(4) High-Speed Wire Rolling Process

The ground steel billet was conveyed to be subjected to high-speed wire rolling to obtain a wire rod with the diameter of phi 5.5 mm, a soaking temperature during heating before rolling was adjusted to make an start rolling temperature to be 1030° C. to 1050° C., and a finish rolling temperature was 950° C. to 990° C. by means of temperature control means such as water cooling in the rolling process, so that the steel billet was basically kept in a recrystallization zone for rolling.

A finishing speed was 108 m/s and a spinning temperature was 890° C. to 910° C.

(5) Cooling Process

Temperature-controlled cooling was carried out on the wire rod on a Stelmor cooling line, and $1^{st}$ to $4^{th}$ fans were started, with air quantities of 100%, 100%, 99% and 95%, respectively; and the rest fans were closed and all heat preservation covers on the Stelmor cooling line were opened.

In front of the $1^{st}$ fan, a running speed of an inlet section of a roller way was 1.0 m/s, the ratio of the running speeds of the roller ways corresponding to the $1^{st}$ to $4^{th}$ fans was 1.10:1.05:1.02:1.00, and the ratio of the running speeds of the roller ways corresponding to the rest fans was 0.8:1.00-1.05:1.00. In addition, a wind speed at an overlapping point was adjusted to be 1.18 times of the wind speed at a non-overlapping point by using optitflex, so that the cooling speed balance of the overlapping point and the non-overlapping point was ensured.

(6) Heat Treatment Process

Offline salt bath heat treatment (alternatively, lead bath heat treatment) was carried out on the wire rod cooled on the Stelmor cooling line, where a temperature of an isothermal phase change stage was 520° C. to 540° C. and the time was 80 s.

By using the production method of this example, the wire rod of Example 7 was obtained.

For the obtained wire rod, the collected and rolled wire rod was packaged by adopting a packing thread, the packing thread and the wire rod were separated by using a piece of linen, and a full-packaging mode was used for packaging. The room temperature of high-speed wire rolling was 25° C., the time of natural aging treatment was 13 days, and then the wire rod was sent to a user for drawing to prepare a steel wire. In the transportation and reshipment processes, a mode using a rubber pad was used for avoiding the scratches of the wire rod.

In general, compared with the prior art, the present invention has the following beneficial effects: by means of the chemical composition design and the improvement of the process technology of the production method, the size and the type of impurities are strictly controlled, the high purity and the structural uniformity are ensured, and a tensile strength and the drawing properties of the wire rod are improved. The wire rod can be suitable for the production of superfine diamond wire buses with low wire breakage rate and high strength, the diameter of the diamond wires prepared by drawing can be 40 μm to 46 μm, the wire breakage rate is less than or equal to 2 times/thousand kilometers, and the tensile strength is more than or equal to 5000 MPa, so that the wire rod is suitable for manufacturing diamond wires for cutting silicon wafers, the requirements of the market on steel wires with good drawing properties, low wire breakage rate and high strength are greatly met, and the technical blank of wire rods for diamond wires 5000 MPa grade or more at home and abroad is filled.

What is claimed is:

1. A method for producing a wire rod for a 5000 MPa-grade diamond wire, wherein the wire rod comprises the following chemical components in percentage by mass: 1.01% to 1.10% of C, 0.15% to 0.40% of Si, 0.30% to 0.60% of Mn, 0.01% to 0.40% of Cr, and either or both of 0.0005% to 0.0020% of B and 0.01% to 0.09% of V; the balance of Fe and unavoidable impurities, wherein the impurities comprise less than or equal to 0.003% of Al, less than or equal to 0.0008% of Ti, less than or equal to 0.005% of S, less than or equal to 0.008% of P, less than or equal to 0.0010% of O and less than or equal to 0.0020% of N; and the production method comprises the following processes:

vacuum melting: melting molten steel by adopting a vacuum melting furnace in an atmosphere with a pressure in the furnace below 10 Pa, and casting same into a steel ingot;

steel ingot remelting: processing the steel ingot by adopting either or both of electroslag remelting and vacuum arc remelting to obtain a remelted ingot, wherein the electroslag remelting is carried out under a protective atmosphere, and a remelting speed of the vacuum arc remelting is 3.0 kg/min to 3.5 kg/min;

billet making and grinding: cogging or forging the remelted ingot into a steel billet, and grinding the steel billet;

wire rolling: rolling the steel billet to form the wire rod, with a start rolling temperature of 1030° C. to 1060° C., and a finish rolling temperature of 950° C. to 1020° C.; and cooling: carrying out temperature-controlled cooling on the wire rod on a cooling line comprising at least four fans, starting and controlling an air quantity of each of the $1^{st}$ to $4^{th}$ fans to be 80% to 100% of a maximum rated air quantity of each of the $1^{st}$ to $4^{th}$ fans.

2. The method for producing a wire rod for a 5000 MPa-grade diamond wire according to claim 1, wherein in the vacuum melting process, the pressure in the furnace is below 5 Pa.

3. The method for producing a wire rod for a 5000 MPa-grade diamond wire according to claim 1, wherein in the vacuum melting process, the molten steel is melted in the vacuum melting furnace by using industrial pure iron with less than or equal to 0.001% of Al, less than or equal to 0.0005% of Ti, less than or equal to 0.001% of Cu, and less than or equal to 0.001% of Ni as a raw material and adding alloy elements according to a composition design.

4. The method for producing a wire rod for a 5000 MPa-grade diamond wire according to claim 1, wherein in the vacuum melting process, a casting temperature is 1580° C. to 1620° C.

5. The method for producing a wire rod for a 5000 MPa-grade diamond wire according to claim 1, wherein in the billet making process, the remelted ingot is cogged or forged into a square billet having a length of 9 m to 16 m and a size of 145 mm×145 mm.

6. The method for producing a wire rod for a 5000 MPa-grade diamond wire according to claim 1, wherein in the billet making process, the remelted ingot is cogged or forged at a temperature of 1130° C. to 1160° C.

7. The method for producing a wire rod for a 5000 MPa-grade diamond wire according to claim 1, wherein in the grinding process, the total grinding depth on the surface of the steel billet is more than or equal to 1.5 mm.

8. The method for producing a wire rod for a 5000 MPa-grade diamond wire according to claim 7, wherein in the grinding process, grinding treatment is carried out on the surface of the steel billet by using 16-mesh, 24-mesh and 30-mesh grinding wheels in sequence, and the grinding depth of each pass is respectively more than or equal to 0.9 mm, more than or equal to 0.5 mm and more than or equal to 0.1 mm, and the grinding width of a corner is more than or equal to 5 mm.

9. The method for producing a wire rod for a 5000 MPa-grade diamond wire according to claim 1, wherein in the high-speed wire rolling process, the steel billet is rolled into the wire rod with a diameter of phi 4.5 mm to phi 5.5 mm.

10. The method for producing a wire rod for a 5000 MPa-grade diamond wire according to claim 1, wherein in the high-speed wire rolling process, a spinning temperature is 890° C. to 920° C.

11. The method for producing a wire rod for a 5000 MPa-grade diamond wire according to claim 1, wherein in the cooling process, in front of the $1^{st}$ fan, a running speed of an inlet section of a roller way is 0.9 m/s to 1.0 m/s.

12. The method for producing a wire rod for a 5000 MPa-grade diamond wire according to claim 11, wherein in the cooling process, all heat preservation covers are opened, and the ratio of the running speeds of the roller ways corresponding to the $1^{st}$ to $4^{th}$ fans is 1.10:1.05:1.02:1.00.

13. The method for producing a wire rod for a 5000 MPa-grade diamond wire according to claim 1, wherein in the cooling process, a wind speed at an overlapping point is adjusted to be 1.1 to 1.4 times of the wind speed at a non-overlapping point.

14. The method for producing a wire rod for a 5000 MPa-grade diamond wire according to claim 1, further comprising a heat treatment process: carrying out salt bath heat treatment or lead bath heat treatment on the wire rod cooled on the cooling line, wherein a temperature of an isothermal phase change stage is 520° C. to 560° C. and time is 20 s to 80 s.

* * * * *